US011217437B2

(12) United States Patent
Newton et al.

(10) Patent No.: US 11,217,437 B2
(45) Date of Patent: Jan. 4, 2022

(54) ELECTRON CAPTURE DISSOCIATION (ECD) UTILIZING ELECTRON BEAM GENERATED LOW ENERGY ELECTRONS

(71) Applicant: Agilent Technologies, Inc., Santa Clara, CA (US)

(72) Inventors: Kenneth R. Newton, Concord, CA (US); Nigel P. Gore, San Jose, CA (US); Mark Denning, San Jose, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 16/298,654

(22) Filed: Mar. 11, 2019

(65) Prior Publication Data

US 2019/0287775 A1 Sep. 19, 2019

Related U.S. Application Data

(60) Provisional application No. 62/644,126, filed on Mar. 16, 2018.

(51) Int. Cl.

| | |
|---|---|
| ***H01J 49/00*** | (2006.01) |
| ***H01J 49/06*** | (2006.01) |
| ***H01J 49/08*** | (2006.01) |

(52) U.S. Cl.

CPC ..... *H01J 49/0054* (2013.01); *H01J 49/067* (2013.01); *H01J 49/08* (2013.01)

(58) Field of Classification Search

CPC ..... H01J 49/0054; H01J 49/067; H01J 49/08
See application file for complete search history.

(56) References Cited

U.S. PATENT DOCUMENTS

| | | | | |
|---|---|---|---|---|
| 3,377,502 A | | 4/1968 | Kurt et al. | |
| 4,731,533 A | * | 3/1988 | Vestal | H01J 49/4215 250/281 |
| 4,988,869 A | * | 1/1991 | Aberth | H01J 37/06 250/281 |
| 5,101,105 A | * | 3/1992 | Fenselau | H01J 49/145 250/281 |
| 9,105,454 B2 | | 8/2015 | Ristroph et al. | |
| 2005/0178955 A1 | * | 8/2005 | Baba | H01J 49/4225 250/281 |

(Continued)

OTHER PUBLICATIONS

Al-Khalili, A., et al. 2004. "Dissociative recombination cross section and branching ratios of protonated dimethyl disulfide and N-methylacetaminde." J. Chem. Phys. vol. 121, No. 12, p. 5700-5708.

(Continued)

*Primary Examiner* — Sean M Luck

(57) ABSTRACT

Electron capture dissociation (ECD) is performed by transmitting an electron beam through a cell along an electron beam axis, generating plasma in the cell by energizing a gas with the electron beam, and transmitting an ion beam through the interaction region along an ion beam axis to produce fragment ions. Generating the plasma forms an interaction region in the cell spaced from and not intersecting the electron beam, and including low-energy electrons effective for ECD. The ion beam axis may be at an angle to and offset from the ion beam axis, such that the electron beam does not intersect the ion beam.

20 Claims, 7 Drawing Sheets

(56) References Cited

U.S. PATENT DOCUMENTS

| | | | | |
|---|---|---|---|---|
| 2005/0258354 | A1* | 11/2005 | Baba | H01J 49/0095 250/281 |
| 2007/0138386 | A1* | 6/2007 | Makarov | H01J 49/0054 250/288 |
| 2011/0049347 | A1* | 3/2011 | Wells | H01J 49/0054 250/282 |
| 2013/0277570 | A1* | 10/2013 | Park | H01J 49/0054 250/424 |
| 2015/0187557 | A1* | 7/2015 | Barofsky | H01J 49/26 250/288 |
| 2016/0126076 | A1* | 5/2016 | Baba | H01J 49/0072 250/489 |

OTHER PUBLICATIONS

Kaczorowska, Malgorzata A. et al.; Electron Induced Dissociation: A Mass Spectrometry Technique for the Structural Analysis of Trinuclear Oxo-Centred Carboxylate-Bridged Iron Complexes; American Society for Mass Spectrometry; Elsevier Inc; Apr. 3, 2010; vol. 21; pp. 1398-1403.

* cited by examiner

ELECTRON CAPTURE DISSOCIATION (ECD) UTILIZING ELECTRON BEAM GENERATED LOW ENERGY ELECTRONS

RELATED APPLICATIONS

This application claims the benefit under 35 U.S.C. § 119(e) of U.S. Provisional Patent Application Ser. No. 62/644,126, filed Mar. 16, 2018, titled "ELECTRON CAPTURE DISSOCIATION (ECD) UTLIZING ELECTRON BEAM GENERATED LOW ENERGY ELECTRONS," the content of which is incorporated by reference herein in its entirety.

TECHNICAL FIELD

The present invention relates generally to plasma-based electron capture dissociation (ECD), and in particular to utilizing an electron beam to generate plasma and low-energy electrons from plasma for ECD.

BACKGROUND

Mass spectrometry (MS) is often utilized to characterize large (high molecular-weight) molecules including long-chain biopolymers (e.g., peptides, proteins, etc.). In the simplest typical work flow, intact large molecules are separated, ionized, and introduced to a mass analyzer where the mass-to-charge (m/z) ratios of the ions are measured and utilized to deduce molecular formulae. In tandem mass spectrometry (MS/MS), additional information is gained by expanding the workflow to include a fragmentation step in which an ion or ions of interest ("precursor" or "parent" ions) are isolated by m/z ratio and then dissociated (fragmented) into smaller "product" or "fragment" ions. The fragment ion masses offer complementary molecular information and consequently play an important role in characterizing large molecules in situations where the mass measurement alone is inadequate.

Numerous fragmentation methods exist, each with its own merits and disadvantages. The mechanism for dissociation usually performed in a Paul trap or other type of radio frequency (RF) based ion processing device is collision-induced dissociation (CID), also referred to as collision-activated dissociation (CAD). CID entails accelerating a precursor ion to a high kinetic energy in the presence of a background neutral gas (or "collision gas") such as helium, nitrogen or argon. When the excited precursor ion collides with the gas molecule or atom, some of the precursor ion's kinetic energy is converted into internal (vibrational) energy. If the internal energy is increased high enough, the precursor ion will break into one or more fragment ions, which may then be mass-analyzed. A similar mechanism is employed in Penning traps, known as sustained off-resonance irradiation (SORI) CID, which entails accelerating the precursor ions so as to increase their radius of cyclotron motion in the presence of a collision gas. An alternative to CID and SORI-CID is infrared multiphoton dissociation (IRMPD), which entails using an IR laser to irradiate the precursor ions whereby they absorb IR photons until they dissociate into fragment ions. IRMPD is also based on vibrational excitation (VE).

CID and IRMPD are not considered to be optimal techniques for dissociating ions of large molecules such as peptides and proteins. For many types of large molecules these VE-based techniques are not able to cause the types of bond cleavages, or a sufficient number of these cleavages, required to yield a complete structural analysis. Currently, electron capture dissociation (ECD) is being investigated as a promising new method for dissociating large molecular ions. In ECD, the well-known technique of electrospray ionization (ESI) is usually selected to produce positive, multiply-charged ions of large molecules by proton attachment. The "soft" or "gentle" technique of ESI leaves the multiply-charged ions intact, i.e., not fragmented. The ions are then irradiated by a stream of low-energy free electrons. If their energy is low enough (typically less than 3 eV), the low-energy electrons can be captured by the positively charged sites on the precursor ions. The energy released in the exothermic capture process is released as internal energy in the ion, which can then very quickly cause bond cleavage (at a peptide backbone, for example) and dissociation. ECD is considered to be a particularly powerful method for fragmenting intact proteins and large peptides. The advantages of ECD are that the fragmentation pattern is simple and predictable, which aids in protein identification, and post-translation modifications of, for example, amino acid residues are kept intact throughout the fragmentation process.

U.S. Pat. No. 9,105,454, the entire contents of which are incorporated by reference herein, describes an ECD device in which plasma is generated as a source of low-energy electrons for use in inducing ECD through interaction between the low-energy electrons and analyte precursor ions. One aspect of U.S. Pat. No. 9,105,454 concerns refining the plasma such that predominantly the low-energy electrons, and not the high-energy electrons or other species of the plasma, interact with the analyte precursor ions There is an ongoing need for ECD apparatuses and methods, including plasma-based ECD apparatuses and methods. There is also a need for ECD apparatuses and methods capable of producing optimal densities of low-energy plasma electrons for effective and efficient fragmentation of sample ions.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, electron capture dissociation (ECD) apparatus includes: a first axial end, a second axial end disposed at a distance from the first axial end along a device axis, and a cell extending between the first axial end and the second axial end; an ion inlet communicating with the cell and configured to communicate with an ion source, the ion inlet disposed on an ion beam axis at an angle to the device axis; an ion outlet communicating with the cell and disposed at a distance from the ion inlet along the ion beam axis; and an electron source disposed at the first axial end and configured to generate an electron beam at an energy high enough to produce plasma from plasma precursor gas in the cell, and configured to direct the electron beam through the cell and toward the second axial end along an electron beam axis parallel to the device axis and offset from the ion beam axis, wherein: the electron beam does not intersect an ion beam traveling along the ion beam axis; and the electron beam does not intersect an ion beam traveling along the ion beam axis; and the electron beam is effective to produce low-energy secondary electrons from the plasma for interaction with the ion beam in an interaction region in the cell adjacent to and spaced from the electron beam.

According to another embodiment, mass spectrometer (MS) system includes: an ECD apparatus according to any of the embodiments disclosed herein; and one or more additional components such as for example, an ion source for producing ions from a sample and communicating with the ECD apparatus, and/or a mass analyzer communicating with the ECD apparatus.

According to another embodiment, a method for performing electron capture dissociation (ECD) includes: transmitting an electron beam through a cell along an electron beam axis; generating plasma in the cell by energizing a gas with the electron beam, wherein generating the plasma forms an interaction region in the cell spaced from and not intersecting the electron beam, and wherein the interaction region comprises low-energy electrons effective for ECD; and before or after generating the plasma, transmitting an ion beam through the interaction region along an ion beam axis to produce fragment ions, wherein the ion beam axis is at an angle to and offset from the ion beam axis, such that the electron beam does not intersect the ion beam.

According to another embodiment, a method for analyzing a sample includes: subjecting ions to electron capture dissociation (ECD) to produce fragment ions; and transferring at least some of the fragment ions to a mass analyzer.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

In the context of the present disclosure, "plasma" ions are ions formed by generating and thereafter sustaining plasma from a plasma precursor gas (also referred to as a plasma-forming gas, background gas, or working gas) such as, for example, argon, helium, etc. Plasma ions are distinguished from "analyte" or "sample" ions, which are ions formed by ionization of sample molecules to enable mass spectral analysis of the sample. Accordingly, analyte ions are the ions primarily of interest in a spectrometric analysis of sample material, whereas plasma ions are typically not of interest. Plasma ions often are considered as not contributing to the ion signal in useful manner, i.e., are often considered to be part of the background noise in the detected ion signal.

As discussed above, the electron capture dissociation (ECD) fragmentation pattern is desirable in many applications. To reach high ECD efficiency in short times and small interaction distances, it is desired to use as dense a source of low energy electrons as possible. Embodiments disclosed herein generate plasma having an electron density that may be many orders of magnitude greater than the electron density achieved by conventionally employed ECD devices. Additionally, embodiments disclosed herein enable the production of high-density, low-energy electron fields required for efficient ECD fragmentation, particularly when performing ECD on a short time scale. Additionally, one or more embodiments disclosed herein may consume less power and reduce the amount of heating of neighboring parts of the system, as compared to conventional electron sources.

In one aspect of the present disclosure, an ECD apparatus is provided. The ECD apparatus is configured to utilize one or more high-energy electron beams to produce plasma, and consequently produce low-energy electrons from the plasma effective for initiating ECD-based fragmentation of analyte ions. The ECD-related interactions occur in a region of the ECD apparatus that is adjacent to and spaced from the electron beam(s). In this ECD interaction region, the energy of the electrons is low enough to be effective for ECD and the density of the low-energy electrons is high.

Figure 1A:
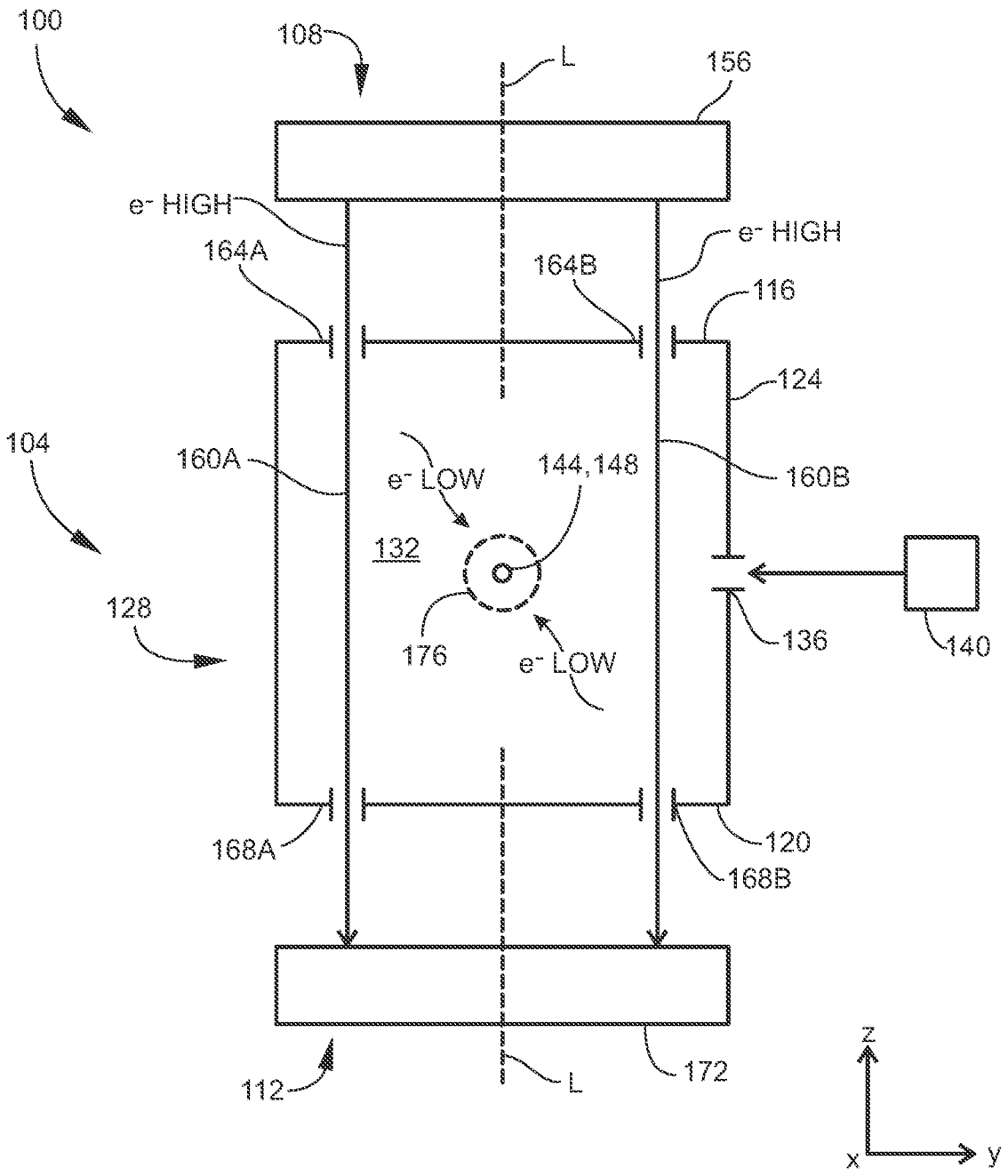
FIG. 1A is a schematic elevation view of an example of an electron capture dissociation (ECD) apparatus according to an embodiment of the present disclosure.
Figure 1B:
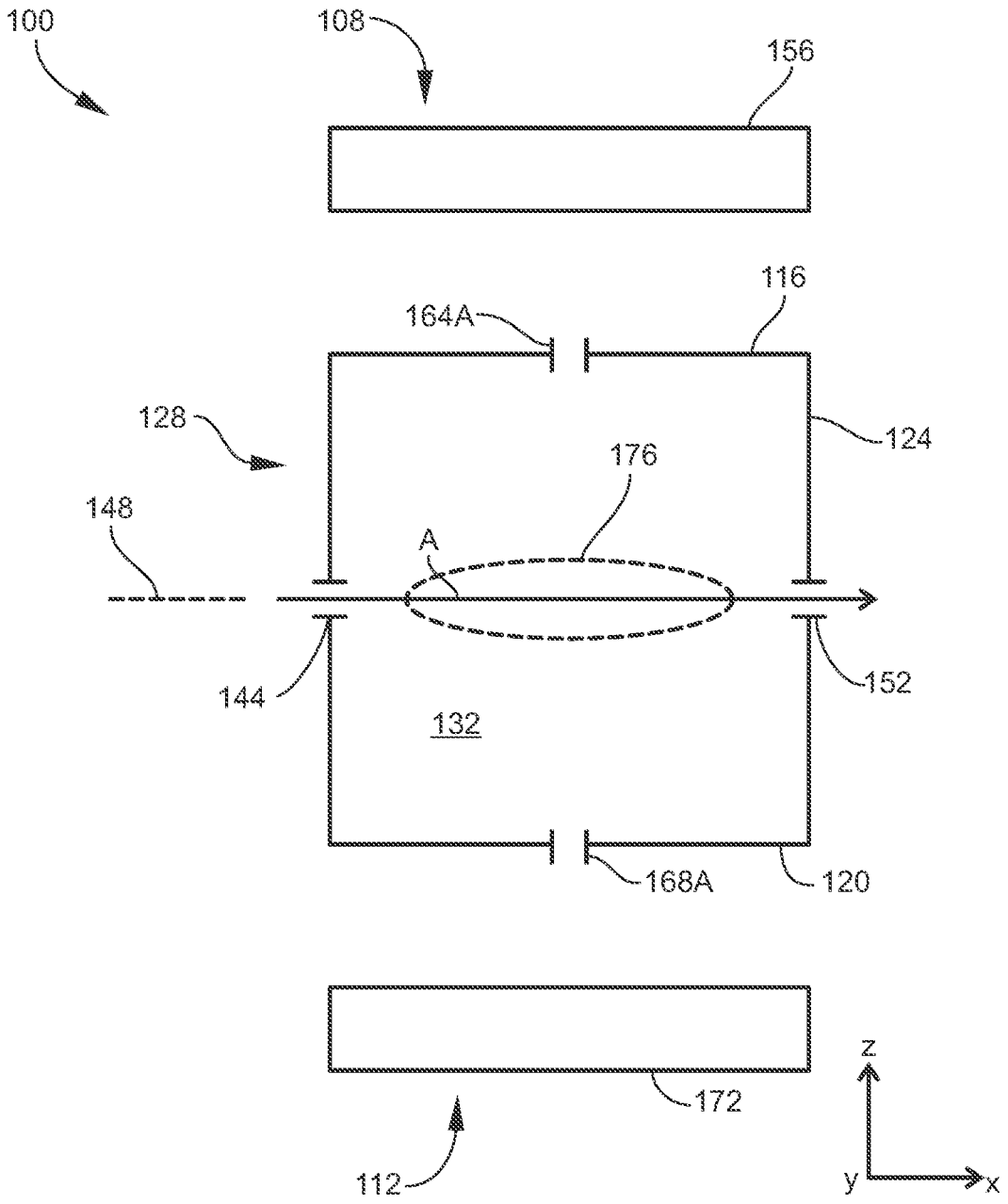
FIG. 1B is another schematic elevation view of the ECD apparatus illustrated in FIG. 1A, where the view is rotated ninety degrees relative to the view of FIG. 1A.

FIG. 1A is a schematic elevation view of an example of an electron capture dissociation (ECD) apparatus 100 according to an embodiment of the present disclosure. FIG. 1B is another schematic elevation view of the ECD apparatus 100, where the view is rotated ninety degrees about the vertical (z) axis relative to the view of FIG. 1A. For illustrative purposes, FIGS. 1A and 1B provide a Cartesian coordinate frame of reference, i.e. defined by an x-axis, y-axis, and z-axis. In each drawing figure, the origin (x=0, y=0, z=0) of the frame of reference has been arbitrarily located relative to the ECD apparatus 100. In the illustrated example, FIG. 1A is a view of the ECD apparatus 100 in the y-z plane and FIG. 1B is a view of the ECD apparatus 100 in the x-z plane. The x-axis, y-axis, and z-axis may alternatively be referred herein to as the x-direction, y-direction, and z-direction, respectively. Also for illustrative purposes, the ECD apparatus 100 may be considered to have (or be arranged along) a device (or apparatus) axis L that corresponds to (or is parallel to) the z-axis.

The ECD apparatus 100 may generally include a body 104 that includes one or more structural components providing structural support and/or positioning for one or more other components of the ECD apparatus 100. One or more of the structural components may be electrically insulating or electrically conductive as appropriate. The ECD apparatus 100 (or the body 104) may generally include a first axial end 108 and a second axial end 112 disposed at a distance from the first axial end 108 along the device axis L. In the present context, the term "axial" relates to the device axis L, such as in reference to a position on or relative to the device axis L. One or more structural components of the body 104 may be (or a combination of structural components may collectively form) a first axial end wall 116, a second axial end wall 120 disposed at a distance from the first axial end wall 116 along the device axis L, and one or more lateral walls 124. The lateral wall 124 extends between the first axial end 108 and the second axial end 112 (such as between the first axial end wall 116 and the second axial end wall 120, or beyond either of them) along the device axis L and at a radial distance from the device axis L.

The ECD apparatus 100 (i.e., the body 104) includes an ECD/plasma cell (or ECD cell) 128 having a cell interior 132 extending between the first axial end 108 and the second axial end 112 along the device axis L. The boundaries of the cell interior 132 may be defined by the first axial end wall 116, the second axial end wall 120, and the lateral wall(s) 124. In a typical embodiment, the ECD cell 128 (or the cell interior 132) is cylindrical about and along the device axis L, although in other embodiments may have a different geometry. The ECD apparatus 100 is configured to produce plasma, low-energy electrons, and analyte fragment ions (or "product" ions) in the ECD cell 128 (i.e., in the cell interior 132) as described further herein.

The ECD apparatus 100 also includes a plasma precursor gas inlet 136 communicating with the ECD cell 128 (i.e., the cell interior 132) and configured to communicate with a plasma precursor gas source 140 via a plasma precursor gas supply line (e.g., conduit, tube, etc.), as indicated by a left-pointing arrow. In the illustrated example, the plasma precursor gas inlet 136 is formed through the lateral wall 124, but more generally has been arbitrarily located in the schematic view of FIG. 1A. The plasma precursor gas is a gas or mixture of gases from which plasma may be generated through a suitable energization mechanism, and which is effective for generating low-energy electrons in an amount and density suitable for ECD. In a typical embodiment, the plasma precursor gas is or includes argon. Examples of other gases that may be utilized as the plasma precursor gas include, but are not limited to, other noble gases (helium, neon, krypton, or xenon), a combination of two or more noble gases, or a combination of a non-noble gas (e.g., hydrogen, or a halogen such as fluorine, chlorine or bromine) with one or more noble gases, as well as nitrogen.

The ECD apparatus 100 also includes an analyte ion inlet 144 communicating with the ECD cell 128, and configured to communicate with an analyte ion source (not shown) of an associated mass spectrometry (MS) system located "upstream" (with respect to ion process flow) of the ECD cell 128. The analyte ion inlet 144 is disposed on an ion beam axis 148 along which an analyte ion beam A travels (FIG. 1B), i.e., the beam of ions to be subjected to the ECD process. In the illustrated example, the analyte ion inlet 144 and ion beam axis 148 are oriented orthogonally to the device axis L, but more generally may be oriented at any other suitable angle relative to the device axis L (e.g., between 0 and 180 degrees). The ECD apparatus 100 further includes an analyte ion outlet 152 (FIG. 1B) communicating with the ECD cell 128 and disposed at a distance from the analyte ion inlet 144 along the ion beam axis 148. The analyte ion outlet 152 may communicate with a component (e.g., mass analyzer) of the associated MS system located "downstream" of the ECD cell 128. The ion inlet 144 may schematically represent an ion inlet lens configured to focus and draw ions into the ECD cell 128. Similarly, the ion outlet 152 may schematically represent an ion outlet lens configured to focus and extract ions out from the ECD cell 128. For this purpose, voltages may be applied to the ion inlet lens and the ion outlet lens, or they may be grounded, as needed. The ion inlet lens and the ion outlet lens may be, for example, cylindrical structures mounted at respective openings of the lateral wall(s) 124 confining the cell interior 132 (see FIGS. 4 and 5).

The ECD apparatus 100 also includes an electron source 156 disposed at the first axial end 108. The electron source 156 is configured to generate high-energy electrons at an energy high enough to produce plasma from the plasma precursor gas in the ECD cell 128. For example, the electron source 156 may include an electron emitter (i.e., a thermionic cathode, or "hot" cathode, not specifically shown) having a surface from which electrons are thermionically emitted in response to heating the electron emitter. As one example, the emitter surface may be the outer surface or coating of a heater filament (or wire) electrically coupled to a voltage source. In such case, the heat energy dissipated by the filament material as a result of resistance to electrical current running through the filament is directly transferred to the emitter surface, resulting in thermionic emission. In another example, the electron emitter may be separated or spaced from a heater device (e.g., a heater wire or other type of heater element) and is indirectly heated by the heater device via heat conduction across the gap. Examples of materials utilized for thermionic emission include, but are not limited to, refractory metals and metal alloys such as tungsten and alloys thereof, rhenium and alloys thereof, tantalum and alloys thereof, and molybdenum and alloys thereof, and various metal oxides (e.g., barium oxide, yttria, etc.), metal borides (e.g., lanthanum hexaboride, etc.), and metal carbides (e.g. tantalum carbide, zirconium carbide, etc.).

In combination with suitable electron optics, the electron source 156 is further configured to focus the as-generated high-energy electrons into one or more high-energy electron beams ($e^-_{HIGH}$), and direct the electron beam(s) through the ECD cell 128 and toward the second axial end 112 along one or more respective electron beam axes 160A and 160B parallel to the device axis L and offset from the ion beam axis 148. The electron optics may be an appropriate combination of electrodes (or lenses) configured to focus and/or accelerate the high-energy electrons. While FIG. 1A illustrates two electron beams (along electron beam axes 160A and 160B), in other embodiments a single electron beam or more than two electron beams may be generated, with each being offset from the ion beam axis 148. In the illustrated example in which two electron beams are generated, the offsets between the two corresponding electron beam axes 160A and 160B and the ion beam axis 148 are distances D along the y-axis. Each offset may be large enough that the electron beam does not intersect the analyte ion beam A traveling along the ion beam axis 148.

To accommodate the desired path(s) of the electron beam(s) through the ECD cell 128, the first axial end wall 116, or both the first axial end wall 116 and the second axial end wall 120, may include respective apertures on the electron beam axis (or axes) 160A and 160B. Thus in the illustrated embodiment, the first axial end wall 116 includes apertures 164A and 164B, and the second axial end wall 120 includes apertures 168A and 168B. The first axial end wall 116, or both the first axial end wall 116 and the second axial end wall 120, may be configured as electrodes that focus and/or accelerate the high-energy electrons of the electron beams, and thus may communicate with electrical circuitry. The first axial end wall 116 may schematically represent two or more electrodes positioned along the device axis L. Likewise, the second axial end wall 120 may schematically represent two or more electrodes positioned along the device axis L. Depending on their position and function, the electrode(s) represented by the first axial end wall 116 and the second axial end wall 120 may be biased with a voltage potential of a desired magnitude and polarity. The voltage potentials applied to such electrodes for controlling the electron beams are typically, but not necessarily, electrostatic (i.e., direct current, or DC) potentials.

The ECD apparatus 100 may also include one or more electron collectors (or electron traps, or beam dumps) 172 to provide a terminus for each electron beam passing through the aperture 168A or 168B. The electron collector(s) 172 may be constructed of an appropriate metal. The electron collector(s) 172 are configured to prevent electron beams incident on one or more surfaces of the electron collector(s) 172 from passing through the electron collector(s) 172. The electron collector(s) 172 may also be configured to measure the electron beam currents.

In an embodiment, one of the apertures 168A and 168B also may be utilized as the plasma precursor gas inlet, instead of or in addition to the illustrated gas inlet 136.

In operation, a flow of plasma precursor gas as described above is established from the plasma precursor gas source 140 into the cell interior 132. The flow of plasma precursor gas may be continuous during active operation of the ECD apparatus 100 to maintain a desired pressure in the ECD cell 128. One or more high-energy electron beams ($e^-_{HIGH}$) are generated and directed in offset relation to the ion beam axis 148 as described above. The electron beams generate and sustain plasma in the cell interior 132 through impact of the high-energy electrons, also referred to herein as primary electrons, with the gas molecules or atoms. For example, the electron beams ionize at least some of the gas molecules or atoms to form plasma ions (as distinguished from the analyte ions of the analyte ion beam A). The electron beams may electronically excite some of the gas molecules or atoms to a level below their threshold levels of ionization, thereby forming metastables instead of ions. Typically, the plasma species of the active plasma generated and maintained by the electron beams include plasma electrons (free electrons created by ionizing collisions, which may exhibit a range of energies), plasma ions (positively charged ions created in the same ionizing collisions), metastable atoms (neutral atoms that have stored energy in a limited-life metastable state as a result of non-ionizing collisions), and ultraviolet (UV) photons (UV light generated by the collisional excitation and decay of atoms), as well as gas molecules or atoms that remain electronically neutral and unexcited. In addition, the interaction between the primary, high-energy electrons of the electron beams and the gas molecules or atoms (either ionized or neutral) produces secondary, low-energy electrons ($e^-_{LOW}$). That is, the electron beam-energized plasma serves as a source of secondary, low-energy electrons. As schematically indicated by curved arrows in FIG. 1A, these low-energy electrons diffuse into an ECD interaction region or zone 176 in the cell interior 132. Secondary electrons may also be produced by impact of the primary electron beams on the electron collector(s) 172, which may also contribute to the population of low-energy electrons utilized for ECD.

In FIG. 1A, the ECD interaction region 176 is schematically depicted (or approximated) as having a circular cross-section in the y-z plane. In FIG. 1B, the ECD interaction region 176 is schematically depicted (or approximated) as having an elliptical cross-section in the x-y plane that is elongated along the ion beam axis 148 between the analyte ion inlet 144 and the analyte ion outlet 152. Alternatively, the ECD interaction region 176 could be approximated as having a cylindrical cross-section in the x-y plane that is elongated along the ion beam axis 148. The best approximation may depend on operating conditions. More generally, it will be understood that the depictions of the shapes or profiles of the ECD interaction region 176 in the views of FIGS. 1A and 1B are made for purposes of schematic illustration only. In practice, the shape (as well as size) of the ECD interaction region 176 as characterized herein is dynamic, as its shape and size depend on factors such as local fluid mechanics, influence by electrical and/or magnetic fields, space-charge effects, etc., as appreciated by persons skilled in the art.

Of all of the different plasma species generated, only low-energy (e.g., less than 3 eV) plasma electrons meet the requirements for successful fragmentation of analyte ions through the mechanism of ECD. High-energy plasma electrons and all other plasma species are typically considered to be undesirable as they may cause unwanted ionization or dissociation events that serve only as background noise in the resulting mass spectrum. For some sample analyses, however, additional fragmentation pathways (e.g., impact with higher-energy electrons, photo-ionization, reaction with plasma ions, etc.) may be desired.

Before or after the plasma has been generated, the analyte ion beam A is transmitted into the cell interior 132 via the analyte ion inlet 144 along the ion beam axis 148, utilizing appropriate ion optics (not shown). The ECD interaction region 176 may be characterized or defined as a region surrounding the analyte ion beam A and through which the analyte ion beam A directly passes along the ion beam axis 148. In the ECD interaction region 176, the low-energy electrons interact with the analyte (precursor) ions to produce analyte fragment ions (or "product" ions) from the analyte precursor ions. The ECD interaction region 176 may also be characterized as containing low-energy electrons having an (average) electron energy (temperature) in a range effective for promoting (inducing) ECD, and having a high (average) electron density of such low-energy electrons such that the probability of interactions between the low-energy electrons and the analyte ions is high, and consequently the yield of fragment ions from the ECD mechanism (or the efficiency of the ECD process) is high.

In one non-limiting example, the average electron energy effective for ECD is in a range of 3 eV or less or about 3 eV or less, while high-energy electrons unsuitable for ECD may be electrons having energies of greater than 3 eV. As further examples, depending on the method or analysis being implemented, it may be more desirable that the low-energy electrons have energies of 2 eV or less, or 1 eV or less, or 0.5 eV or less. It has been found that the ECD cross-section increases monotonically with decreasing electron energy. See Al-Khalili et al., "Dissociative recombination cross section and branching ratios of protonated dimethyl disulfide and N-methylacetamide," J. Chem. Phys., Vol. 121, No. 12, 2004, p. 5700-5708. Thus, for many applications it is desirable that the electrons utilized for ECD be as cool as possible.

In one non-limiting example, a "high" average electron density is in a range from $1\times10^8$ $cm^{-3}$ to $1\times10^{12}$ $cm^3$.

Generally, the electron energy of the high-energy electron beams is high enough to effectively generate and sustain the plasma, i.e., high enough to ionize the plasma precursor gas. In one non-limiting example, the (average) electron energy of the high-energy electron beams is in a range from 15 eV to 1000 eV. The current in each electron beam may be on the order of milliamps (mA), for example 10 mA.

In one non-limiting example, the fluid pressure in the cell interior 132 during operation is on the order of milliTorr (mTorr), for example 5 mTorr. In an embodiment, some of the gas contributing to the pressure and plasma in the cell interior 132 may have originated in a downstream device (e.g., inert collision gas added to a collision cell) and diffused into the ECD cell 128 via the analyte ion outlet 152.

As the fragment ions are formed, they (along with non-fragmented analyte precursor ions) are transmitted out from the cell interior 132 along the ion beam axis 148 via the analyte ion outlet 152, utilizing appropriate ion optics (not shown). The ions exiting the ECD cell 128 may then be further processed in accordance with the method being implemented, e.g., transmitted to a mass analyzer.

In the present embodiment, the electron beam axis or axes 160A and 160B do not intersect the ion beam axis 148, and likewise the electron beam(s) do not intersect the analyte ion beam A. Accordingly, the primary, high-energy electrons do not interact with the analyte ions. Instead, only the secondary, low-energy electrons that have diffused into the ECD interaction region 176 interact with the analyte ions. In the present embodiment, the ECD apparatus 100 is configured to establish the ECD interaction region 176 adjacent to, but spaced at a distance from, the electron beam(s). Specifically in the illustrated example, the ECD interaction region 176 is located between the two electron beams provided. Although a single electron beam may be utilized, the use of two or more electron beams may be beneficial for making the spatial distribution of the electrons more uniform and increasing the electron density. The ECD interaction region 176 also is positioned between the analyte ion inlet 144 and the analyte ion outlet 152. In an embodiment, the ECD interaction region 176 is positioned generally in the center of the cell interior 132. It may be advantageous to position the plasma precursor gas inlet 136 at or near the plane (x-y plane in the present example) at which the analyte ion inlet 144 and the analyte ion outlet 152 are positioned. This may ensure plasma with a high density of gas molecules or atoms is generated in the vicinity of the ECD interaction region 176, which may increase the amount of low-energy electrons available for interaction with the analyte ions in the ECD interaction region 176.

In some embodiments, the ECD apparatus 100 may be configured to generate axial electric and/or magnetic fields in the ECD cell 128 having spatial and polar orientations that radially confine the low-energy electrons (and charged plasma species), i.e., cause the low-energy electrons to diffuse radially inward toward the center (or the device axis L) of the ECD cell 128 where the analyte ion beam A is located, and/or prevent the low-energy electrons from diffusing radially outward away from the center or device axis L. Accordingly, axial electric and/or magnetic fields may contribute to establishing an effective ECD interaction region 176. In the present context, an "axial" electric or magnetic field is one for which a substantial portion of the field lines in the cell interior 132 are substantially parallel to the device axis L (or to the electron beam axes 160A and 160B). As one example, the lateral wall(s) 124 may schematically represent one or more electrodes to which DC voltage potentials are applied. Additionally or alternatively, magnets (see FIG. 2) may be mounted on or near the lateral wall(s) 124 so as to surround all or a portion of the cell interior 132 in a magnetic field. The magnetic flux density should be low enough to prevent too much alteration of the analyte ion trajectories. A magnetic flux density that is too high might also prevent the low-energy electrons from diffusing out of the electron beam volume and into the ECD interaction region 176. In one non-limiting example, the magnetic flux density is in a range from $50\times10^{-4}$ tesla (T) to $800\times10^{-4}$ T.

The body 104 may include structural components providing alignment features between the ECD cell 128 and the first axial end 108 and/or between the ECD cell 128 and the second axial end 112 to ensure the electrons pass through all apertures and reach the electron collector 172 despite any rotation of the electrons beams due to electric and magnetic fields in the ECD cell 128.

The ECD apparatus 100 may include a spring between the ECD cell 128 and the electron collector 172 that allows for good thermal contact between the electron collector 172 and other portions of the ECD apparatus 100. The spring allows the non-critical distance from the exit end of the ECD cell 128 to the electron collector 172 to vary while maintaining the good thermal contact.

The low-energy ions initially generated in the primary electron beams may have a higher average electron energy than is desired for some ECD applications. However, the electron energy may be reduced through scattering of the electrons with the neutral gas molecules or atoms, as well as other processes having electron cooling effects that may occur in the plasma. For example, the ambipolar electric field generated due to the presence of plasma ions may slow down the electrons.

In an embodiment, electron cooling may be enhanced without excessive loss of low-energy electron density through selection of the neutral gas formulation or blend in the ECD cell 128. For example, if argon is utilized as the primary plasma precursor gas, then adding a small amount of one or more additional gases (e.g., nitrogen) may enhance electron cooling without resulting in too much of a reduction in electron density. The neutral plasma-forming gases utilized (e.g., argon, nitrogen, etc.) are expected to have little effect on the analyte ions in the ECD cell 128.

Additionally or alternatively, specific gas species may be selected for inclusion in the neutral gas formulation to achieve other functions. For example, certain types of plasma ions may interact with the analyte ions to induce other types of charge transfer reactions, such as electron transfer dissociation (ETD). Relative amounts of charge transfer reactions and charge reduction reactions (i.e., with no fragmentation) may be adjusted by adjusting the gas composition, primary electron energy, fluid pressure in the ECD cell 128, etc.

As noted above, for some sample analyses, higher-energy dissociation mechanisms may be desired, such as in addition to the lower-energy ECD mechanism. Thus, in some embodiments, one or more of the high-energy primary electron beams ($e^-_{HIGH}$) may be positioned close enough to (or directly intersect) the analyte ion beam A to allow for some interaction between the primary electron beam(s) and the analyte ion beam A, thereby enabling a higher-energy type of dissociation mechanism, for example electron impact ionization (EI). In an embodiment, the electron source 156 may be configured to allow adjustment of the positions of one or more of the electron beams relative to the ion beam axis 148. For example, component(s) of the electron source 156 supporting the electron emitters may be movable (linearly translatable and/or rotatable) to enable switching of an electron beam axis (or axes) 160A and 160B alternately into and out of alignment or intersection relation with the ion beam axis 148.

The operating parameters (e.g., voltage potentials applied to electrodes, timing and energy of electron beams, gas flow and pressure, etc.) of the ECD apparatus 100 may be controlled by the system controller (e.g., computing device) of an associated MS system. The ECD apparatus 100 may include integrated probes or sensors to provide feedback signals to the system controller to control or adjust one or more operating parameters. One non-limiting example is a Langmuir or other electrostatic probe to diagnose either the bulk plasma or the beam electrons, or a probe for measuring the electron collector current.

Figure 2:
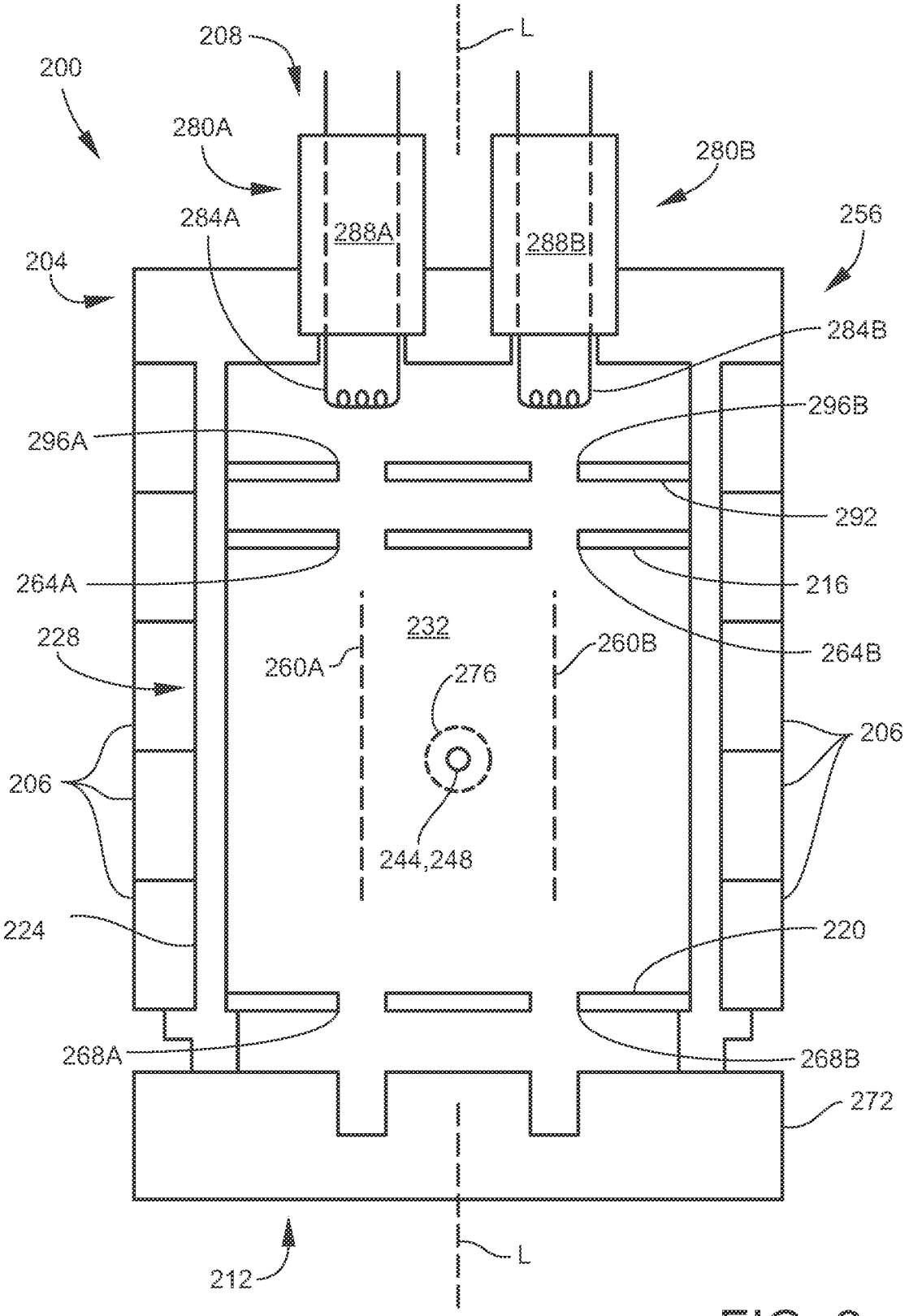
FIG. 2 is a schematic cross-sectional elevation view of an example of an ECD apparatus according to another embodiment.

FIG. 2 is a schematic cross-sectional elevation view of an example of an ECD apparatus 200 according to another embodiment. The ECD apparatus 200 may generally include a body 204 that includes one or more structural components providing structural support and/or positioning for one or more other components of the ECD apparatus 200. One or more of the structural components may be electrically insulating or electrically conductive as appropriate. The ECD apparatus 200 (or the body 204) may generally include a first axial end 208 and a second axial end 212 disposed at a distance from the first axial end 208 along the device axis L. The body 204 may further include a first axial end wall 216 at or near the first axial end 208, a second axial end wall 220 at or near the second axial end 212, and one or more lateral walls 224 extending between and possibly beyond the first axial end 208 and the second axial end 212 along the device axis L at a radial distance therefrom. The foregoing components define an ECD cell 228 having a cell interior 232 extending between the first axial end 208 and the second axial end 212 along the device axis L. The ECD cell 228 (or the cell interior 232) may be cylindrical or have another geometry.

The ECD apparatus 200 also includes a plasma precursor gas inlet (not shown) for introducing one or more plasma precursor gases into the ECD cell 228 at a pressure suitable for ECD. The ECD apparatus 200 also includes an analyte ion inlet 244 and analyte ion outlet (not shown) for transmitting an analyte ion beam (see ion beam A in FIG. 1B) through the ECD cell 228 along an ion beam axis 248. In the illustrated example, the ion beam axis 248 is oriented orthogonally to the device axis L, but more generally may be oriented at any other suitable angle relative to the device axis L.

The ECD apparatus 200 also includes an electron source 256 disposed at the first axial end 208. The electron source 256 includes one or more electron source units configured to separately emit electrons. In the illustrated embodiment, two electron source units 280A and 280B are mounted in parallel to the body 204. The electron source units 280A and 280B include respective electron emitters 284A and 284B, which in the illustrated embodiment are heated filaments mounted in respective electrically insulating members 288A and 288B (constructed of, for example, a ceramic) and electrically coupled to voltage sources. The heated filaments operate as thermionic cathodes that emit high-energy primary electrons, as appreciated by persons skilled in the art. The primary electrons are focused as high-energy electron beams, which are directed through the ECD cell 228 and toward the second axial end 212 (such as to an electron collector 272) along respective electron beam axes 260A and 260B parallel to the device axis L and offset from the ion beam axis 248.

Various electron optics may be utilized for focusing and/or accelerating the primary electrons. For example, the first axial end wall 216 and/or the second axial end wall 220 may be configured as electrodes. The first axial end wall 216 includes apertures 264A and 264B, and the second axial end wall 220 includes apertures 268A and 268B, through which the primary electron beams pass. Additionally or alternatively, other electrodes may be provided for focusing and/or accelerating the primary electrons, such as one or more electrodes 292 axially disposed between the electron source 256 and the ECD cell 228. Such other electrode(s) 292 also have apertures 296A and 296B respectively aligned on the electron beam axes 260A and 260B.

In the present embodiment, the ECD apparatus 200 also includes one or more magnets 206 configured to form an axial magnetic field that constrains diffusion of the electrons within the plasma. In the illustrated example, a stack of magnets 206 supported by structural members of the body 204 surround the ECD cell 228. The magnets 206 may, for example, be ring-shaped and may be permanent magnets or electromagnets. In an embodiment, the physical dimensions, shapes, and positions of the magnets 206 result in the generation of an (approximated) uniform axial magnetic field extending from the electron emitters 284A and 284B at the first axial end 208 to the electron collector 272 at the second axial end 212. One of the centrally positioned magnets 206 near the axial position of the analyte ion beam has holes to accommodate the analyte ion inlet 244 and the analyte ion outlet (and possibly also the plasma precursor gas inlet), and to allow passage of the ion beam without significantly deflecting the ion beam or disrupting the electron beams or the low-energy electron population of the plasma.

As in the embodiment described above with reference to FIGS. 1A and 1B, with the primary electron beams activated to generate plasma in the ECD cell 228, the ECD apparatus 200 creates an ECD interaction region 276 located on the ion beam axis 248 and between (and spaced from) the primary electron beams. Moreover, the ECD interaction region 276 may be characterized as a zone containing a high density of low-energy secondary electrons effective for ECD.

In another embodiment, the electron source may be configured to generate one or more electron beams based on the hollow cathode effect, as appreciated by persons skilled in the art. In this case, the electron emitters are hollow cathodes (not shown), which are typically cylindrical electrodes. In an embodiment, the hollow cathodes may be positioned about where the filaments 284A and 284B are located in FIG. 2, with the open ends of the hollow cathodes facing the ECD cell 228. The inside surfaces of the hollow cathodes may serve as the emitter surfaces. Primary electrons emitted from the inside surfaces may impact the inside surfaces one or more times and consequently generate secondary electrons that contribute to the high-energy electron beams. Other types of cold cathodes (cathodes not electrically heated, by a filament or otherwise) may be suitable as well.

Figure 3:
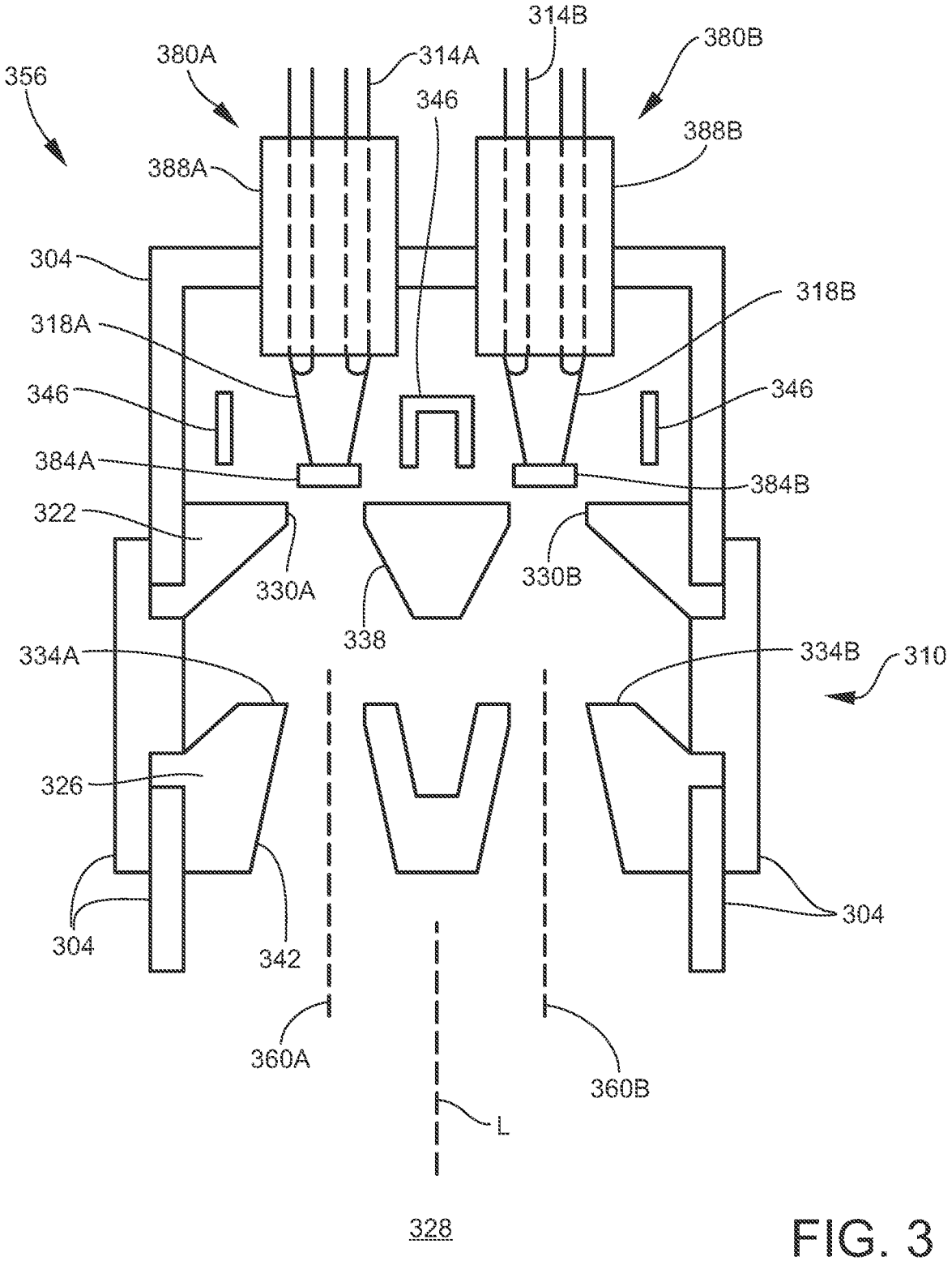
FIG. 3 is a schematic cross-sectional elevation view of an example of an electron source and associated electron optics according to another embodiment.

FIG. 3 is a schematic cross-sectional elevation view of an example of an electron source 356 and associated electron optics 310 according to another embodiment. The electron source 356 may be utilized in any of the ECD apparatuses disclosed herein.

The electron source 356 includes one or more electron source units configured to separately emit electrons. In the illustrated embodiment, two electron source units 380A and 380B are mounted in parallel to a body 304 of an associated ECD apparatus. The electron source units 380A and 380B include respective electron emitters 384A and 384B, which in the illustrated embodiment are thermionically emissive disk-shaped cathodes. The electron emitters 384A and 384B are positioned separately from respective sets of heater wires 314A and 314B (each electron emitter 384A and 384B having two heater wires 314A or 314B in the present example). The heater wires 314A and 314B are mounted in respective electrically insulating members 388A and 388B and electrically coupled to voltage sources. In the illustrated embodiment, the electron emitters 384A and 384B are attached to respective sets of pins 318A and 318B of the electron source units 380A and 380B, such that the electron emitters 384A and 384B are suspended below and at a distance from the heater wires 314A and 314B. In operation, the electron emitters 384A and 384B are heated indirectly by the heater wires 314A and 314B and in response emit high-energy primary electrons. The electron optics 310 focus the primary electrons as high-energy electron beams on respective electron beam axes 360A and 360B. The electron beam axes 360A and 360B are parallel to the device axis L and offset from the ion beam axis of an associated ECD cell 328 positioned below the electron source 356 and electron optics 310.

In the present embodiment, the electron optics 310 includes a cathode 322 and an anode 326, both illustrated in cross-section. The cathode 322 has apertures 330A and 330B respectively aligned on the electron beam axes 360A and 360B. The anode 326 likewise has apertures 334A and 334B respectively aligned on the electron beam axes 360A and 360B. The front sides (facing the ECD cell 328 below, from the perspective of FIG. 3) of the cathode 322 and the anode 326 may have respective tapered surfaces 338 and 342 surrounding the apertures 330A, 330B, 334A, and 334B, to assist in shaping the electric field and focusing the emitted electrons. The tapered surfaces 338 and 342 taper outwardly in the direction of the ECD cell 328, and may be straight or curved surfaces. A potential difference (e.g., 500 V) may be applied between the cathode 322 and the anode 326 to form an electron beam lens that helps to extract newly emitted electrons from the electron emitters 384A and 384B and focus the electrons into well-formed electron beams. The potential difference may also be useful as a barrier to reduce the transmission of plasma ions back toward the cathode-anode region (between the cathode 322 and the anode 326), thereby reducing damage to the surfaces of the electron emitters 384A and 384B and other surfaces in the cathode-anode region. Moreover, the apertures below the cathode-anode region are small enough to serve as conductance barriers that keep the gas pressure in the cathode-anode region low, thereby reducing plasma production in the cathode-anode region as well as reducing ion damage to surfaces in the cathode-anode region.

In the present embodiment, the electron emitters 384A and 384B are separate from the additional cathode 322. The electron emitters 384A and 384B are aligned with the respective apertures 330A and 330B of the cathode 322, on the respective electron beam axes 360A and 360B. The axial position of the electron emitters 384A and 384B is offset from the axial position of the apertures 330A and 330B, whereby the electron emitters 384A and 384B are positioned slightly above (in the direction away from the anode 326 and ECD cell 328) the apertures 330A and 330B of the cathode 322. This configuration accommodates the tolerance stack-up of the various parts of the electron source 356 and associated ECD apparatus. The configuration may be viewed as a modified Pierce cathode. The conventional Pierce cathode is a monolithic cathode having a single, curved emitting surface for generating a single electron beam. In the illustrated embodiment in which there is gap between the electron emitters 384A and 384B and the surrounding additional cathode 322, the deviation from the ideal extractor field may be compensated by applying a potential to the additional cathode 322 that is slightly different from the potential applied to the electron emitters 384A and 384B. As one non-limiting example, if the potential difference between the cathode 322 and the anode 326 is 500 V and the electron emitters 384A and 384B are axially offset from the cathode 322 by around 10% of the axial distance between the cathode 322 and the anode 326, the difference in the potentials applied to the cathode 322 and the electron emitters 384A and 384B of around 20V may be optimal.

Also in the present embodiment, the electron source 356 includes a heat shield 346 (illustrated in cross-section) arranged around the exposed looped portions of the heater wires 314A and 314B behind the electron emitters 384A and 384B. The heat shield 346 reduces the power required for heating the electron emitters 384A and 384B up to operating temperature.

Figure 4:
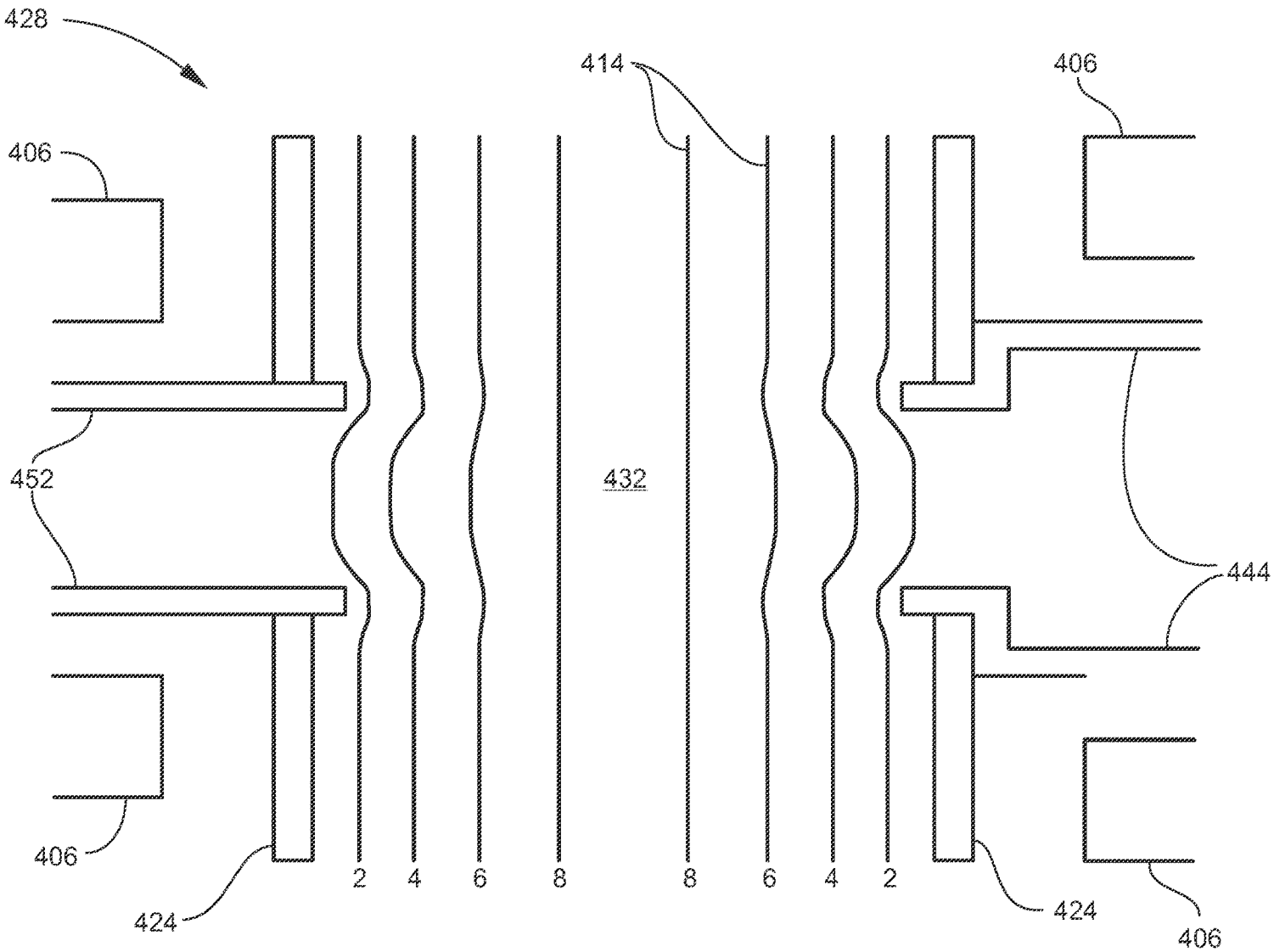
FIG. 4 is a schematic cross-sectional elevation view of an example of (a portion of) an ECD cell.

FIG. 4 is a schematic cross-sectional elevation view of an example of (a portion of) an ECD cell 428. The ECD cell 428 may correspond to the ECD cell of any of the embodiments described above. Accordingly, a cell interior 432 is bounded in part by a lateral wall or walls 424. In addition, the ECD cell 428 includes an ion inlet lens 444 and an ion outlet lens 452 positioned at respective openings into the cell interior 432 (i.e., at the ion inlet and the ion outlet, respectively). Magnets 406 may also be provided as described above. The ECD cell 428 is depicted in the same orientation as the ECD cell 128 illustrated in FIG. 1B, but rotated 180 degrees about the central or device axis (which is vertical in FIGS. 1B and 4) such that the ion inlet lens 444 is on the right and the ion outlet lens 452 is on the left. Thus again, from the perspective of FIG. 4, the electron source (not shown) is located above the ECD cell 428 and the electron collector (not shown) is located below the ECD cell 428. The view of FIG. 4 is in the plane of the ion beam axis, which is centered between the two electron beams. The ion inlet lens 444 and the ion outlet lens 452 are attached to the lateral wall 424, and all three components are at the same potential.

FIG. 4 further schematically illustrates an estimation of equipotential lines 414 representing the electric field generated in the cell interior 432 when the plasma is active. The numbers (2, 4, 6, 8) associated with the equipotential lines 414 are intended to be proportional to voltage, but may be as much as a factor of 3 higher or lower depending on the plasma density and temperature achieved. The numbers show that the electric potential decreases in the radial direction outward (toward the ion inlet lens 444 and the ion outlet lens 452). As illustrated, as the equipotential lines 414 approach the ion inlet lens 444 and the ion outlet lens 452, the equipotential lines 414 become distorted, i.e., they transition from being straight and parallel with the device axis to curving outward toward the ion inlet lens 444 and the ion outlet lens 452. This condition is due to the presence of the ion inlet lens 444 and the ion outlet lens 452, e.g., due to perturbations in the main electric field caused by the presence of the ion inlet lens 444 and the ion outlet lens 452, and/or due to local electric fields generated at the ion inlet lens 444 and the ion outlet lens 452. The curved portions of the equipotential lines 414 near the ion inlet lens 444 and the ion outlet lens 452 will act to defocus the ion beam as it passes through the ECD cell 428 from the ion inlet lens 444 to the ion outlet lens 452. This impairment to the ion beam transmission may decrease the efficiency of the ECD mechanism.

Figure 5:
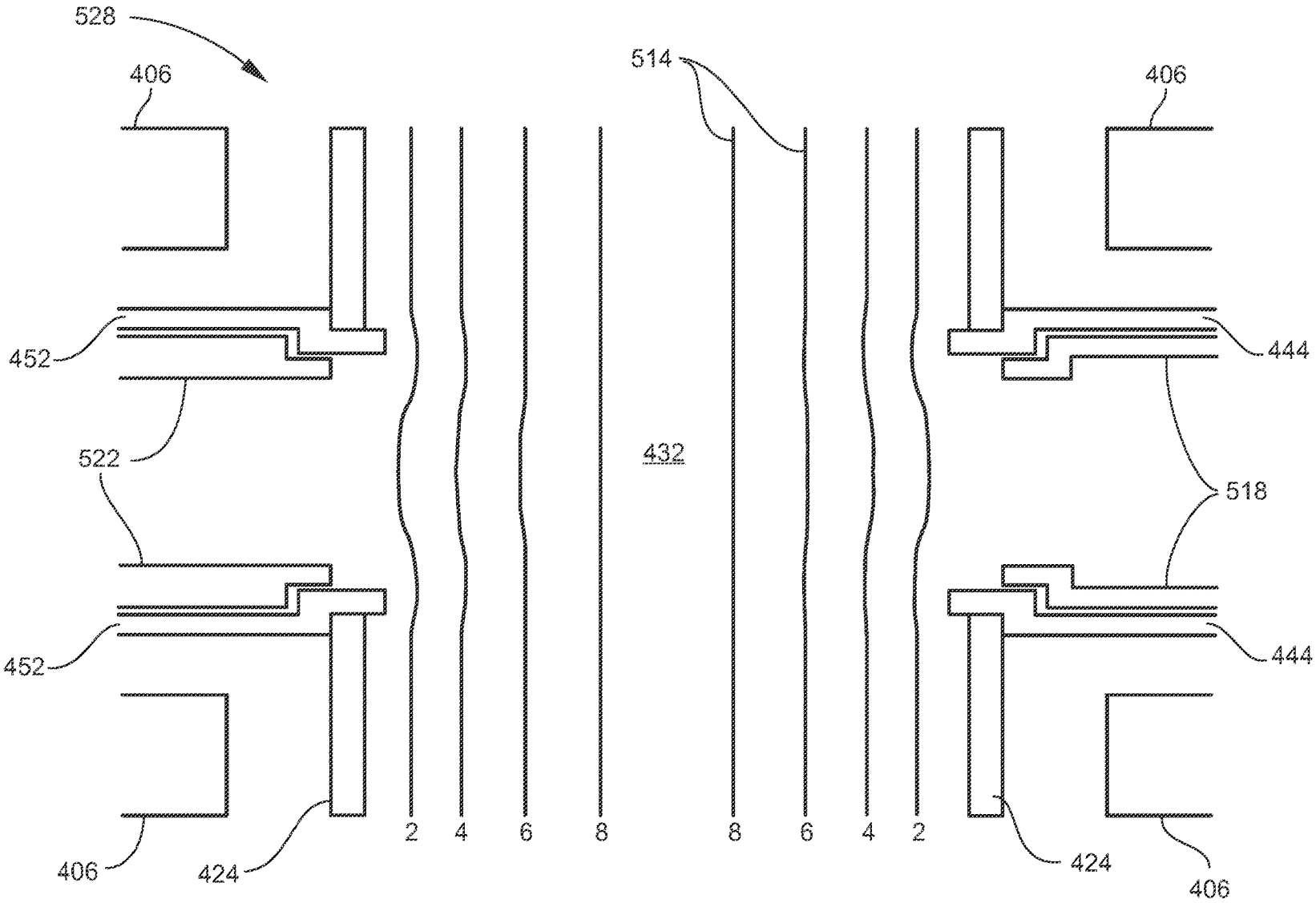
FIG. 5 is a schematic cross-sectional elevation view of another example of (a portion of) an ECD cell.

FIG. 5 illustrates an embodiment that addresses this issue. Specifically, FIG. 5 is a schematic cross-sectional elevation view of another example of (a portion of) an ECD cell 528. In addition to the first (or outer) ion inlet lens 444 ("outer" with respect to the ion beam axis), a second (or inner) ion inlet lens 518 ("inner" with respect to the ion beam axis) is provided. The second ion inlet lens 518 is spaced and separate from the first ion inlet lens 444. For example, the first ion inlet lens 444 and the second ion inlet lens 518 may be cylindrical, with the first ion inlet lens 444 coaxially surrounding the second ion inlet lens 518. Similarly, in addition to the first (or outer) ion outlet lens 452, a second (or inner) ion outlet lens 522 is provided, which is spaced and separate from the first ion outlet lens 452 and therefore independently addressable by a voltage source. The first ion outlet lens 452 and the second ion outlet lens 522 may be configured similarly to the first ion inlet lens 444 and the second ion inlet lens 518, and thus may be, for example, concentric cylindrical electrode structures.

By this configuration, the respective voltages applied to the first ion inlet lens 444 and the second ion inlet lens 518, and to the first ion outlet lens 452 and the second ion outlet lens 522, are independently adjustable and may be different from each other. That is, there may be a potential difference between the first ion inlet lens 444 and the second ion inlet lens 518, and a potential difference between the first ion outlet lens 452 and the second ion outlet lens 522. As one non-exclusive example, the voltage difference applied to the first ion inlet lens 444 and the second ion inlet lens 518, and the voltage difference applied to the first ion outlet lens 452 and the second ion outlet lens 522, may be in a range from −24 V to +24 V. Consequently, this configuration allows control over the plasma boundary shape in the vicinity of the ion inlet (first ion inlet lens 444 and second ion inlet lens 518) and the ion outlet (first ion outlet lens 452 and second ion outlet lens 522). FIG. 5 illustrates equipotential lines 514, which may be compared to the equipotential lines 414 shown in FIG. 4. As FIG. 5 illustrates, the voltages applied to the first ion inlet lens 444, second ion inlet lens 518, first ion outlet lens 452, and the second ion outlet lens 522, can be adjusted as needed to lessen the degree of curvature of the equipotential lines 514 near the ion inlet and the ion outlet. Consequently, this configuration may reduce or eliminate the distortion in the ion beam, thereby improving ion beam transmission. These lens voltages may also be adjusted to provide a compromise between achieving the best signal for ion beam transmission while also maximizing the ECD signal.

While FIG. 5 illustrates the first (outer) ion inlet lens 444 and the first (outer) ion outlet lens 452 as being structures separate from the cell body, in particular the lateral wall(s) 424, the first ion inlet lens 444 and the first ion outlet lens 452 may be integral parts of the lateral wall(s) 424. For example, the first ion inlet lens 444 and the first ion outlet lens 452 may be openings through the lateral wall(s) 424, with the second (inner) ion inlet lens 518 and the second (inner) ion outlet lens 522 being appropriately mounted in the openings.

In some embodiments, other ion lenses may be provided at greater distances than what is shown in FIGS. 4 and 5.

Figure 6:
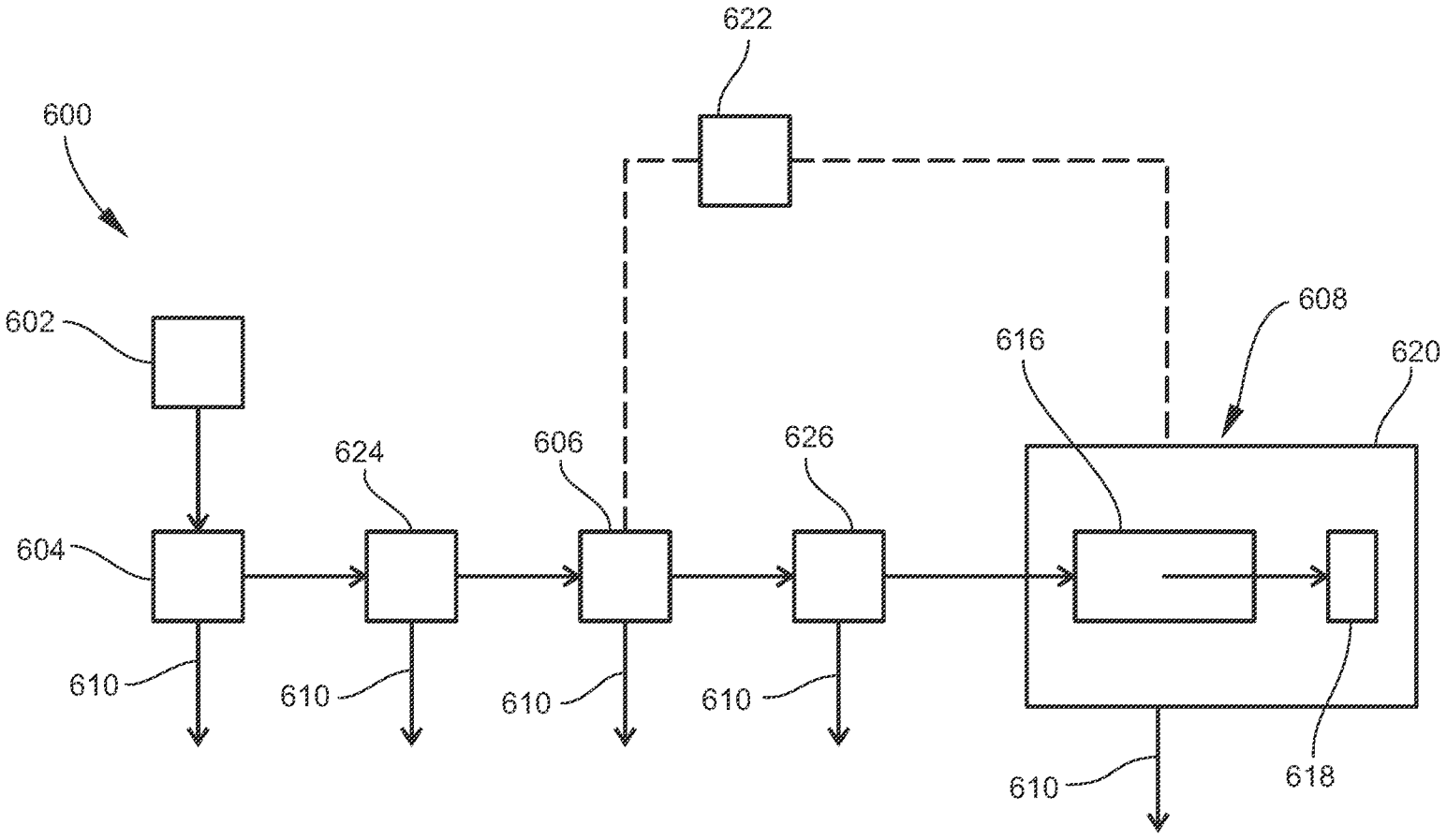
FIG. 6 is a schematic view of an example of a mass spectrometry (MS) system according to an embodiment.

FIG. 6 is a schematic view of an example of a mass spectrometry (MS) system 600 according to some embodiments. The MS system 600 generally includes a sample source 602, an analyte ion source 604, an ECD apparatus 606, a mass spectrometer (MS) 608, and a vacuum system for maintaining the interiors of the ECD apparatus 606, the MS 608 (and in some embodiments the ion source 604) and other components of the MS system 600 at controlled, sub-atmospheric pressure levels, and for removing non-analytical neutral particles from some of the components depending on their function. The vacuum system is schematically depicted by vacuum lines 610 leading from various components. The vacuum lines 610 are schematically representative of one or more vacuum-generating pumps and associated plumbing and other components as appreciated by persons skilled in the art. The structure and operation of various types of sample sources, ion sources, MSs, and associated components are generally understood by persons skilled in the art, and thus will be described only briefly as necessary for understanding the presently disclosed subject matter. In practice, the ion source 604 and ECD apparatus 606 may be integrated with the MS 608 or otherwise considered as the front end or inlet of the MS 608, and thus in some embodiments may be considered as components of the MS 608.

The sample source 602 may be any device or system for supplying a sample to be analyzed to the ion source 604. The sample may be provided in a liquid-phase or gas-phase (or vapor) form that flows from the sample source 602 into the ion source 604. In hyphenated systems such as liquid chromatography-mass spectrometry (LC-MS) or gas chromatography-mass spectrometry (GC-MS) systems, the sample source 602 may be an LC or GC system, in which case an analytical column of the LC or GC system is interfaced with the ion source 604 through suitable hardware to supply analytically separated compounds of the sample. The pressure in the sample source 602 is typically around atmospheric pressure (around 760 Torr) or at a somewhat sub-atmospheric pressure. Alternatively, the sample source 602 may be a solid target loaded into the ion source 604 when, for example, the ion source 604 is configured for implementing a technique based on desorption/ionization.

Generally, the ion source 604 is configured for producing analyte ions from a sample provided by the sample source 602 and directing the as-produced ions into the ECD apparatus 606. In typical embodiments where ionization is followed by ECD, the ion source 604 is an electrospray ionization (ESI) apparatus. In other embodiments, the ion source 604 may be configured for matrix-assisted laser desorption ionization (MALDI) or matrix-assisted laser desorption electrospray ionization (MALDESI). More generally, however, the ion source 604 may be configured for carrying out any atmospheric-pressure or vacuum ionization technique compatible with the ECD apparatus 606 and methods disclosed herein. Thus, the internal pressure of the ion source 604 is generally not limited, but rather may range from atmospheric pressure down to a sub-atmospheric or vacuum-level pressure. The internal pressure of the ion source 604 may be higher than or about the same as the internal pressure of the ECD apparatus 606.

The analyte ions produced by ion source 604 may be focused as an analyte ion beam and transferred to the ECD apparatus 606 by suitable ion optics (not shown). The ECD apparatus 606 may be configured according to any of the embodiments disclosed herein. The operating pressure of the ECD apparatus 606 is typically higher than the very low vacuum pressure inside the MS 608. In some embodiments, the operating pressure in the ECD cell is in a range from 0.001 Torr to 0.1 Torr. Fragment ions (and non-dissociated precursor ions) produced by the ECD apparatus 606 may be focused and transferred to the MS 608 by suitable ion optics (not shown).

The MS 608 may generally include a mass analyzer 616 and an ion detector 618 enclosed in a housing 620. The vacuum system maintains the interior of the mass analyzer 616 at very low (vacuum) pressure such as, for example, in a range from $10^4$ to $10^{-9}$ Torr. The mass analyzer 616 may be any device configured for separating, sorting or filtering analyte ions on the basis of their respective m/z ratios. Examples of mass analyzers include, but are not limited to, multipole electrode structures (e.g., quadrupole mass filters, linear ion traps, three-dimensional Paul traps, etc.), time-of-flight (TOF) analyzers, electrostatic traps (e.g. Kingdon, Knight and ORBITRAP® traps), and ion cyclotron resonance (ICR) traps (FT-ICR or FTMS, also known as Penning traps). The ion detector 618 may be any device configured for collecting and measuring the flux (or current) of mass-discriminated ions outputted from the mass analyzer 616. Examples of ion detectors 618 include, but are not limited to, image current detectors, electron multipliers, photomultipliers, Faraday cups, and micro-channel plate (MCP) detectors.

When configured as a TOF analyzer, the mass analyzer 616 includes a high-voltage ion accelerator (e.g., an ion pusher or puller) and a flight tube. The ion accelerator accelerates ions into the flight tube (either orthogonally to or on-axis with the incoming ion beam) as ion packets according to a desired pulse rate. As the ions travel through the flight tube, ions of different masses reach different velocities and thus become separated and reach the ion detector 618 at different times.

The MS system 600 may further include a system controller 622, which is schematically depicted in FIG. 6 as representing one or more modules configured for controlling, monitoring and/or timing various functional aspects of the MS system 600 such as, for example, controlling the operations of the sample source 602; the ion source 604; the ECD apparatus 606 as described above; and the MS 608; as well as controlling various gas flow rates, temperature and pressure conditions, and any other ion processing components provided between the illustrated devices. The system controller 622 may also be configured for receiving the ion detection signals from the ion detector 618 and performing other tasks relating to data acquisition and signal analysis as necessary to generate a mass spectrum characterizing the sample under analysis. The system controller 622 may include a computer-readable medium that includes instructions for performing any of the methods disclosed herein. For all such purposes, the system controller 622 is schematically illustrated as being in signal communication with various components of the MS system 600 via wired or wireless communication links, as partially represented by dashed lines leading to the ECD apparatus 606 and the MS 608.

In some embodiments, the MS system 600 includes a mass filter 624 positioned between the ion source 604 and the ECD apparatus 606. In one embodiment, the mass filter 624 is positioned immediately upstream of the analyte ion inlet of the ECD apparatus 606, although optionally an intermediate ion guide or ion optics may be provided as needed. Typically, the mass filter 624 is configured as a linear quadrupole instrument that applies a composite RF/DC electric field with parameters effective for mass filtering ions. By this configuration, precursor ions having a single m/z ratio or within a small range of m/z ratio may be selected for transfer into the ECD apparatus 606 for fragmentation and subsequent mass spectral analysis, while all other ions transmitted from the ion source 604 are prevented from entering the ECD apparatus 606 at that time.

Additionally or alternatively, the MS system 600 includes a collision cell 626. In one embodiment, the collision cell 626 is positioned immediately downstream of the analyte ion outlet of the ECD apparatus 606, although optionally an intermediate ion guide or ion optics may be provided as needed. The collision cell 626 may have any configuration suitable for performing collision-induced dissociation (CID) as a fragmentation mechanism complementary to ECD. Typically, the collision cell 626 is configured as an RF-only multipole ion guide enclosed in a chamber in which an inert collision gas is introduced under conditions (e.g., pressure, temperature, and axial DC gradient across the collision cell 626) effective for CID.

When both the mass filter 624 and the collision cell 626 are provided as illustrated, the MS system 600 can be configured as triple quad (QqQ) or quadrupole time-of-flight (QqTOF) system, depending on whether the final mass analyzer 616 is a quadrupole or time-of-flight instrument, respectively. In either case, the ECD apparatus 606 provides an added dimension to the analysis of samples, as described herein.

The MS system 600 may be operated without inducing CID while the collision cell 626 is installed. In this case, the collision cell 626 may be operated at a lower pressure as a linear ion guide, or further as an ion beam cooler with the (lower pressure) collision gas functioning as a damping gas.

It will be understood that FIG. 6 is a high-level schematic depiction of the MS system 600 disclosed herein. As appreciated by persons skilled in the art, other components, such as additional structures, ion optics, ion guides, ion gates, ion traps, and electronics may be included needed for practical implementations, depending on how the MS system 600 is to be configured for a given application.

It will be understood that the system controller 622 schematically depicted in FIG. 6 may include one or more types of hardware, firmware and/or software, as well as one or more memories and databases. The system controller 622 typically includes a main electronic processor providing overall control, and may include one or more electronic processors configured for dedicated control operations or specific signal processing tasks. The system controller 622 may also schematically represent all voltage sources not specifically shown, as well as timing controllers, clocks, frequency/waveform generators and the like as needed for operating the various components of the MS system 600. The system controller 622 may also be representative of one or more types of user interface devices, such as user input devices (e.g., keypad, touch screen, mouse, and the like), user output devices (e.g., display screen, printer, visual indicators or alerts, audible indicators or alerts, and the like), a graphical user interface (GUI) controlled by software, and devices for loading media readable by the electronic processor (e.g., logic instructions embodied in software, data, and the like). The system controller 622 may include an operating system (e.g., Microsoft Windows® software) for controlling and managing various functions of the system controller 622.

It will be understood that one or more of the processes, sub-processes, and process steps described herein may be performed by hardware, firmware, software, or a combination of two or more of the foregoing, on one or more electronic or digitally-controlled devices. The software may reside in a software memory (not shown) in a suitable electronic processing component or system such as, for example, the system controller 622 schematically depicted in FIG. 6. The software memory may include an ordered listing of executable instructions for implementing logical functions (that is, "logic" that may be implemented in digital form such as digital circuitry or source code, or in analog form such as an analog source such as an analog electrical, sound, or video signal). The instructions may be executed within a processing module, which includes, for example, one or more microprocessors, general purpose processors, combinations of processors, digital signal processors (DSPs), or application specific integrated circuits (ASICs). Further, the schematic diagrams describe a logical division of functions having physical (hardware and/or software) implementations that are not limited by architecture or the physical layout of the functions. The examples of systems described herein may be implemented in a variety of configurations and operate as hardware/software components in a single hardware/software unit, or in separate hardware/software units.

The executable instructions may be implemented as a computer program product having instructions stored therein which, when executed by a processing module of an electronic system (e.g., the system controller 622 in FIG. 6), direct the electronic system to carry out the instructions. The computer program product may be selectively embodied in any non-transitory computer-readable storage medium for use by or in connection with an instruction execution system, apparatus, or device, such as an electronic computer-based system, processor-containing system, or other system that may selectively fetch the instructions from the instruction execution system, apparatus, or device and execute the instructions. In the context of this disclosure, a computer-readable storage medium is any non-transitory means that may store the program for use by or in connection with the instruction execution system, apparatus, or device. The non-transitory computer-readable storage medium may selectively be, for example, an electronic, magnetic, optical, electromagnetic, infrared, or semiconductor system, apparatus, or device. A non-exhaustive list of more specific examples of non-transitory computer readable media include: an electrical connection having one or more wires (electronic); a portable computer diskette (magnetic); a random access memory (electronic); a read-only memory (electronic); an erasable programmable read only memory such as, for example, flash memory (electronic); a compact disc memory such as, for example, CD-ROM, CD-R, CD-RW (optical); and digital versatile disc memory, i.e., DVD (optical). Note that the non-transitory computer-readable storage medium may even be paper or another suitable medium upon which the program is printed, as the program can be electronically captured via, for instance, optical scanning of the paper or other medium, then compiled, interpreted, or otherwise processed in a suitable manner if necessary, and then stored in a computer memory or machine memory.

Exemplary Embodiments

Exemplary embodiments provided in accordance with the presently disclosed subject matter include, but are not limited to, the following:

1. An electron capture dissociation (ECD) apparatus, comprising: a first axial end, a second axial end disposed at a distance from the first axial end along a device axis, and a cell extending between the first axial end and the second axial end; an ion inlet communicating with the cell and configured to communicate with an ion source, the ion inlet disposed on an ion beam axis at an angle to the device axis; an ion outlet communicating with the cell and disposed at a distance from the ion inlet along the ion beam axis; and an electron source configured to generate an electron beam at an energy high enough to produce plasma from plasma precursor gas in the cell, and configured to direct the electron beam through the cell along an electron beam axis which is along or parallel to the device axis and offset from the ion beam axis, wherein: the electron beam does not intersect an ion beam traveling along the ion beam axis; and the electron beam is effective to produce low-energy electrons from the plasma for interaction with the ion beam in an interaction region in the cell spaced from and not intersecting the electron beam.

2. The ECD apparatus of embodiment 1, comprising a plasma precursor gas inlet communicating with the cell and configured to communicate with a plasma precursor gas source.

3. The ECD apparatus of embodiment 1 or 2, wherein the cell comprises a first axial end wall having a first aperture, a second axial end wall disposed at a distance from the first axial end wall along the device axis and having a second aperture, and a lateral wall between the first axial end wall and the second axial end wall.

4. The ECD apparatus of embodiment 3, wherein the first axial end wall is an electrode configured to focus the electron beam on the electron beam axis.

5. The ECD apparatus of embodiment 3 or 4, wherein the ion inlet and the ion outlet pass through the lateral wall.

6. The ECD apparatus of any of the preceding embodiments, comprising ion optics between the electron source and the cell, and configured to focus the electron beam on the electron beam axis.

7. The ECD apparatus of embodiment 6, wherein the ion optics comprise a focusing cathode and an anode spaced from the focusing cathode along the device axis.

8. The ECD apparatus of embodiment 7, wherein at least one of the focusing cathode or the anode has an aperture opening to a surrounding tapered surface.

9. The ECD apparatus of embodiment 7 or 8, wherein the electron source comprises an electron-emitting cathode separate from the focusing cathode.

10. The ECD apparatus of embodiment 9, wherein the focusing cathode has an aperture on the electron beam axis, and the electron-emitting cathode is disposed on the electron beam axis at an axial distance from the focusing cathode.

11. The ECD apparatus of any of the preceding embodiments, comprising an electron collector disposed at the second axial end and configured to receive the electron beam.

12. The ECD apparatus of any of the preceding embodiments, wherein the electron source comprises an electron emitter.

13. The ECD apparatus of embodiment 12, wherein the electron emitter is selected from the group consisting of: a heater filament; an electron emitter configured to be heated by a heater element; and an electron emitter configured to emit electrons without being heated.

14. The ECD apparatus of any of the preceding embodiments, comprising a magnet surrounding the cell and configured to generate an axial magnetic field in the cell.

15. The ECD apparatus of any of the preceding embodiments, wherein the electron source is configured to generate the electron beam at an energy in a range from 15 eV to 1000 eV, and is effective to produce low-energy electrons from the plasma having energies of 3 eV or less.

16. The ECD apparatus of any of the preceding embodiments, wherein: the electron beam is a first electron beam, and the electron beam axis is a first electron beam axis; the electron source is further configured to generate and direct a second electron beam through the cell and toward the second axial end along a second electron beam axis parallel to the device axis and offset from the ion beam axis; the second electron beam does not intersect the ion beam; and the interaction region is spaced from the second electron beam between the first electron beam and the second electron beam, and does not intersect the second electron beam.

17. The ECD apparatus of embodiment 16, wherein the electron source comprises a first electron emitter disposed on the first electron beam axis and a second electron emitter disposed on the second electron beam axis.

18. The ECD apparatus of any of the preceding embodiments, comprising an ion inlet lens positioned at the ion inlet and configured to focus the ion beam, and an ion outlet lens positioned at the ion outlet and configured to focus the ion beam.

19. The ECD apparatus of any of the preceding embodiments, comprising a first ion inlet lens positioned at the ion inlet, a second ion inlet lens positioned at the ion inlet and spaced from the first ion inlet lens, a first ion outlet lens positioned at the ion outlet, and a second ion outlet lens positioned at the ion outlet and spaced from the first ion outlet lens.

20. The ECD apparatus of embodiment 19, wherein the first ion inlet lens surrounds the second ion inlet lens, and the first ion outlet lens surrounds the second ion outlet lens.

21. A mass spectrometer (MS) system, comprising: the ECD apparatus of any of the preceding embodiments; and a device selected from the group consisting of: an ion source communicating with the ECD apparatus; a mass analyzer communicating with the ECD apparatus; and both of the foregoing.

22. The MS system of embodiment 21, comprising an ion guide or a mass filter configured to transfer the ion beam into the cell.

23. The MS system of embodiment 21 or 22, comprising the mass analyzer, and a collision cell between the ECD apparatus and the mass analyzer.

24. The MS system of any of embodiments 21-23, comprising the mass analyzer, wherein the mass analyzer comprises a mass filter, an ion trap, or a time-of-flight analyzer.

25. The MS system of any of embodiments 21-23, comprising the mass analyzer, wherein the mass analyzer comprises a flight tube and an ion accelerator for injecting packets of ions into the flight tube.

26. A method for performing electron capture dissociation (ECD), the method comprising: transmitting an electron beam through a cell along an electron beam axis; generating plasma in the cell by energizing a gas with the electron beam, wherein generating the plasma forms an interaction region in the cell spaced from and not intersecting the electron beam, and wherein the interaction region comprises low-energy electrons effective for ECD; and before or after generating the plasma, transmitting an ion beam through the interaction region along an ion beam axis to produce fragment ions, wherein the ion beam axis is at an angle to and offset from the electron beam axis, such that the electron beam does not intersect the ion beam.

27. The method of embodiment 26, comprising generating the electron beam at an energy in a range from 15 eV to 1000 eV, wherein the low-energy electrons from the plasma have energies of 3 eV or less.

28. The method of embodiment 26 or 27, wherein the electron beam is a first electron beam and the electron beam axis is a first electron beam axis, and further comprising: transmitting a second electron beam through the cell along a second electron beam axis parallel to the first electron beam, wherein the second electron beam axis is at an angle to and offset from the ion beam axis, such that the second electron beam does not intersect the ion beam, and the interaction region is spaced from and does not intersect the first electron beam and the second electron beam.

29. The method of embodiment 28, wherein the interaction region is between the first electron beam and the second electron beam.

30. The method of any of embodiments 26-29, wherein transmitting comprises transmitting the electron beam from an ion inlet to an ion outlet, and further comprising applying respective voltages to a first ion inlet lens positioned at the ion inlet, a second ion inlet lens positioned at the ion inlet and spaced from the first ion inlet lens, a first ion outlet lens positioned at the ion outlet, and a second ion outlet lens positioned at the ion outlet and spaced from the first ion outlet lens.

31. The method of embodiment 30, comprising adjusting one or more of the respective voltages to adjust a shape of a boundary of the plasma.

32. A method for analyzing a sample, the method comprising: subjecting analyte ions to electron capture dissociation (ECD) according to the method of any of embodiments 26-31 to produce fragment ions; and transferring at least some of the fragment ions to a mass analyzer.

33. The method of embodiment 32, comprising producing precursor ions from a sample, and transferring precursor ions of a selected mass or mass range to an ECD apparatus, wherein only the selected precursor ions are subjected to ECD.

34. The method of embodiment 32 or 33, comprising, after producing the fragment ions, transferring the fragment ions to a collision cell to produce additional fragment ions, wherein at least some of the additional fragment ions are transferred to the mass analyzer.

35. The method of any of embodiments 32-34, wherein transferring at least some of the fragment ions comprises transferring fragment ions of a selected mass or mass range to the mass analyzer.

It will be understood that the term "in signal communication" or "in electrical communication" as used herein means that two or more systems, devices, components, modules, or sub-modules are capable of communicating with each other via signals that travel over some type of signal path. The signals may be communication, power, data, or energy signals, which may communicate information, power, or energy from a first system, device, component, module, or sub-module to a second system, device, component, module, or sub-module along a signal path between the first and second system, device, component, module, or sub-module. The signal paths may include physical, electrical, magnetic, electromagnetic, electrochemical, optical, wired, or wireless connections. The signal paths may also include additional systems, devices, components, modules, or sub-modules between the first and second system, device, component, module, or sub-module.

More generally, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components. Thus, the two components may be directly or indirectly connected to each other.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. An electron capture dissociation (ECD) apparatus, comprising:

a cell positioned on a device axis;

an ion inlet communicating with the cell and configured to communicate with an analyte ion source, the ion inlet disposed on an ion beam axis along which an analyte ion beam travels at an angle to the device axis;

an ion outlet communicating with the cell and disposed at a distance from the ion inlet along the ion beam axis; and an electron source configured to generate and focus high-energy primary electrons as a focused electron beam at an energy high enough to produce plasma from plasma precursor gas in the cell, and configured to direct the electron beam through the cell and along an electron beam axis, the electron beam axis being along or parallel to the device axis and offset from the ion beam axis, wherein:

the focused electron beam is effective to produce low-energy secondary electrons from the plasma for interaction with the analyte ion beam in an ECD interaction region in the cell, the low-energy secondary electrons having an energy lower than the high-energy primary electrons of the electron beam and being low enough to be effective for ECD; and the electron source is configured to position the focused electron beam relative to the ion inlet and the ion outlet such that the analyte ion beam passes through the ECD interaction region, and the ECD interaction region is spaced from the focused electron beam by a distance large enough that the focused electron beam does not intersect the analyte ion beam.

2. The ECD apparatus of claim 1, wherein the cell comprises a first axial end wall having a first aperture, a second axial end wall disposed at a distance from the first axial end wall along the device axis and having a second aperture, and a lateral wall between the first axial end wall and the second axial end wall.

3. The ECD apparatus of claim 2, wherein the first axial end wall is an electrode configured to focus the electron beam on the electron beam axis.

4. The ECD apparatus of claim 2, wherein the ion inlet and the ion outlet pass through the lateral wall.

5. The ECD apparatus of claim 1, comprising ion optics between the electron source and the cell, and configured to focus the electron beam on the electron beam axis.

6. The ECD apparatus of claim 5, wherein the ion optics comprise a focusing cathode and an anode spaced from the focusing cathode along the device axis.

7. The ECD apparatus of claim 6, wherein at least one of the focusing cathode or the anode has an aperture opening to a surrounding tapered surface.

8. The ECD apparatus of claim 6, wherein the electron source comprises an electron-emitting cathode separate from the focusing cathode.

9. The ECD apparatus of claim 8, wherein the focusing cathode has an aperture on the electron beam axis, and the electron-emitting cathode is disposed on the electron beam axis at an axial distance from the focusing cathode.

10. The ECD apparatus of claim 1, comprising an electron collector disposed at the second axial end and configured to receive the electron beam.

11. The ECD apparatus of claim 1, wherein the electron source comprises an electron emitter.

12. The ECD apparatus of claim 11, wherein the electron emitter is selected from the group consisting of: a heater filament; an electron emitter configured to be heated by a heater element; and an electron emitter configured to emit electrons without being heated.

13. The ECD apparatus of claim 1, comprising a magnet surrounding the cell and configured to generate an axial magnetic field in the cell.

14. The ECD apparatus of claim 1, wherein the electron source is configured to generate the electron beam at an energy in a range from 15 eV to 1000 eV, and is effective to produce low-energy electrons from the plasma having energies of 3 eV or less.

15. The ECD apparatus of claim 1, wherein:

the focused electron beam is a first focused electron beam, and the electron beam axis is a first electron beam axis;

the electron source is further configured to generate and direct a second focused electron beam through the cell and along a second electron beam axis which is along or parallel to the device axis and offset from the ion beam axis;

the second focused electron beam does not intersect the ion beam; and the interaction region is spaced from the second focused electron beam between the first focused electron beam and the second focused electron beam, and does not intersect the second focused electron beam.

16. The ECD apparatus of claim 15, wherein the electron source comprises a first electron emitter disposed on the first electron beam axis and a second electron emitter disposed on the second electron beam axis.

17. The ECD apparatus of claim 1, comprising a feature selected from the group consisting of:

an ion inlet lens positioned at the ion inlet and configured to focus the ion beam, and an ion outlet lens positioned at the ion outlet and configured to focus the ion beam; and a first ion inlet lens positioned at the ion inlet, a second ion inlet lens positioned at the ion inlet and spaced from the first ion inlet lens, a first ion outlet lens positioned at the ion outlet, and a second ion outlet lens positioned at the ion outlet and spaced from the first ion outlet lens.

18. A method for performing electron capture dissociation (ECD), the method comprising:

transmitting a focused electron beam through a cell along an electron beam axis, the focused electron beam comprising high-energy primary electrons at an energy high enough to produce plasma from plasma precursor gas in the cell;

generating plasma in the cell by energizing the plasma precursor gas with the focused electron beam, wherein generating the plasma forms an ECD interaction region in the cell spaced from and not intersecting the focused electron beam, and wherein the ECD interaction region comprises low-energy secondary electrons from the plasma, the low-energy secondary electrons having an energy lower than the high-energy primary electrons of the electron beam and being low enough to be effective for ECD; and before or after generating the plasma, transmitting an analyte ion beam through the ECD interaction region from an ion inlet to an ion outlet along an ion beam axis to produce fragment ions by ECD, wherein the focused electron beam is positioned relative to the ion inlet and the ion outlet such that the electron beam axis is offset from the ion beam axis, and the ECD interaction region is spaced from the focused electron beam by a distance large enough that the focused electron beam does not intersect the analyte ion beam.

19. The ECD apparatus of claim 1, comprising a plasma precursor gas inlet communicating with the cell and configured to communicate with a plasma precursor gas source.

20. The ECD apparatus of claim 19, wherein the plasma precursor gas inlet is configured to direct a flow of the plasma precursor gas into the cell effective to maintain an operating pressure in the cell in a range from 0.001 Torr to 0.1 Torr.

* * * * *